US011878337B2

(12) United States Patent
Ingvarsson

(10) Patent No.: US 11,878,337 B2
(45) Date of Patent: Jan. 23, 2024

(54) ROLL-FORMING MACHINE AND METHOD FOR ROLL-FORMING

(71) Applicant: Ingvest AB, Borlänge (SE)

(72) Inventor: Lars Ingvarsson, Borlänge (SE)

(73) Assignee: Ingvest AB, Borlänge (SE)

( * ) Notice: Subject to any disclaimer, the term of this patent is extended or adjusted under 35 U.S.C. 154(b) by 176 days.

(21) Appl. No.: 17/607,104

(22) PCT Filed: Apr. 30, 2020

(86) PCT No.: PCT/EP2020/062004
§ 371 (c)(1),
(2) Date: Oct. 28, 2021

(87) PCT Pub. No.: WO2020/254023
PCT Pub. Date: Dec. 24, 2020

(65) Prior Publication Data

US 2022/0226877 A1 Jul. 21, 2022

(30) Foreign Application Priority Data

Jun. 19, 2019 (EP) ..... 19181268

(51) Int. Cl.
*B21D 5/08* (2006.01)
*B21D 5/00* (2006.01)
*B21D 47/01* (2006.01)

(52) U.S. Cl.
CPC ..... *B21D 5/083* (2013.01); *B21D 5/004* (2013.01); *B21D 47/01* (2013.01)

(58) Field of Classification Search
CPC . B21D 5/08; B21D 5/083; B21D 5/06; B21D 7/08
See application file for complete search history.

(56) References Cited

U.S. PATENT DOCUMENTS

| | | | | |
|---|---|---|---|---|
| 8,763,438 | B2 | 7/2014 | Sato et al. | |
| 2009/0113974 | A1* | 5/2009 | Ingvarsson | B21D 5/083 72/181 |
| 2017/0203350 | A1 | 7/2017 | Okada et al. | |

FOREIGN PATENT DOCUMENTS

| | | | |
|---|---|---|---|
| DE | 10 2007 059 439 | B3 | 4/2009 |
| EP | 3 088 091 | A1 | 11/2016 |
| WO | 2007/008152 | A1 | 1/2007 |

* cited by examiner

*Primary Examiner* — Debra M Sullivan
(74) *Attorney, Agent, or Firm* — Dilworth & Barrese, LLP

(57) ABSTRACT

Roll-forming machine for forming, from a flat sheet metal strip (5), a hat beam which has a profile that varies along its length. The machine comprises several consecutively arranged forming stations, each of which comprising a first pair of clamping rollers (22*a*, 22*b*) for clamping a side flange (3*a*) of the hat beam and a second pair of clamping rollers (23*a*, 23*b*) for clamping a central flange (2) thereof. The clamping rollers of said second pair are individually displaceable in vertical direction and horizontally in the feeding direction of the sheet metal strip. The displacement of the clamping rollers (23*a*, 23*b*) of said second pair is controlled by an electronic control device during a forming operation such that a plane that goes through the centre axes (CA3, CA4) of both these clamping rollers is maintained perpendicular to the part of the central flange (2) received in the nip (31) between these clamping rollers.

14 Claims, 9 Drawing Sheets

ROLL-FORMING MACHINE AND METHOD FOR ROLL-FORMING

FIELD OF THE INVENTION AND PRIOR ART

The present invention relates to a roll-forming machine and a method according to the description herein.

The roll-forming machine of the present invention is to be used for roll-forming a flat sheet metal strip into a hat beam which has a profile that varies along its length and which has a central flange, first and second side flanges on opposite sides of the central flange, a first web extending between the central flange and the first side flange and a second web extending between the central flange and the second side flange. A roll-forming machine for roll-forming a flat sheet metal strip into such a hat beam is previously known from WO 2007/008152 A1.

OBJECT OF THE INVENTION

The object of the present invention is to achieve a further development of a roll-forming machine of the above-mentioned type so as to provide a roll-forming machine that is improved in at least some aspect.

SUMMARY OF THE INVENTION

According to the present invention, the above-mentioned object is achieved by a roll-forming machine having the features defined herein.

The roll-forming machine of the present invention comprises several forming stations for successively roll-forming a flat sheet metal strip into a hat beam of the above-mentioned type, wherein each forming station comprises a first pair of clamping rollers for clamping one of the side flanges and a second pair of clamping rollers for clamping the central flange, the first and second pairs of clamping rollers being configured to fold one of the webs in relation to the associated side flange over a first peripheral folding edge on a clamping roller included in the first pair of clamping rollers and in relation to the central flange over a second peripheral folding edge on a clamping roller included in the second pair of clamping rollers. According to the invention, the clamping rollers of the second pair of clamping rollers are configured to be individually displaceable during a forming operation upwards and downwards in vertical direction and horizontally forwards and backwards as seen in the intended feeding direction of the sheet metal strip through the forming stations, wherein the displacement of the clamping rollers of the second pair of clamping rollers during a forming operation is controlled by means of an electronic control device in such a manner that a plane that goes through the centre axes of both clamping rollers of the second pair of clamping rollers is always maintained perpendicular to the part of the central flange received in the nip between these clamping rollers.

The roll-forming machine of the invention is particularly designed to be used for forming hat beams where each side flange is flat and extends straightly and where the vertical distance between the central flange and the side flanges varies along the length of the hat beam so that the central flange has a curvature or inclination as seen in a longitudinal section through the central flange. Such hat beams may for instance have a design of the type illustrated in FIGS. 1*a*-1*c*, where a part of the central flange bulges inwards, or a design of the type illustrated in FIGS. 2*a*-2*c*, where a part of the central flange bulges outwards. The above-mentioned displaceability of the clamping rollers of the second pair of clamping rollers during a forming operation upwards and downwards in vertical direction and horizontally forwards and backwards as seen in the feeding direction implies that it will be possible to adapt the positions of these clamping rollers in dependence on the curvature or inclination of the central flange in such a manner that the plane that goes through the centre axes of both of these clamping rollers is always maintained perpendicular to the part of the central flange received in the nip between these clamping rollers. Hereby, no undesired bending stresses will be induced in the central flange when a vertically curved or inclined part of the central flange is passing between the two clamping rollers in question.

Furthermore, by keeping the central flange clamped between two clamping rollers, a roll-forming machine of the present invention can be used for roll-forming a hat beam where the width of the central flange is relatively small, as will be explained in closer detail in the description following below.

Further advantageous features of the roll-forming machine according to the present invention will appear from the description following below.

The invention also relates to a method having the features defined herein.

Further advantageous features of the method according to the present invention will appear from the description following below.

BRIEF DESCRIPTION OF THE DRAWINGS

The invention will in the following be more closely described by means of embodiment examples, with reference to the appended drawings. In the drawings.

DETAILED DESCRIPTION OF EMBODIMENTS OF THE INVENTION

The roll-forming machine of the present invention is particularly intended to be used for roll-forming a flat sheet metal strip into a hat beam 1, 1' which has a U-shaped cross-sectional shape that varies along the length of the hat beam, wherein the hat beam 1, 1' has a central flange 2, first and second side flanges 3*a*, 3*b* on opposite sides of the central flange 2, a first web 4*a* extending between the central flange 2 and the first side flange 3*a* and a second web 4*b* extending between the central flange 2 and the second side flange 3*b*.

The side flanges 3*a*, 3*b* of the illustrated hat beams 1, 1' are flat and straight and located in plane with each other, wherein the vertical distance between the central flange 2 and the side flanges 3*a*, 3*b* varies along the length of the hat beam such that the central flange 2 has a curvature as seen in a longitudinal section through the central flange. In the illustrated examples, the width of the central flange 2 is constant throughout the length of the hat beam 1, 1'. However, the roll-forming machine of the present invention may of course also be configured to form hat beams with other designs than here illustrated. For example, the forming stations of the roll-forming machine may as an alternative be configured to form a hat beam with side flanges 3*a*, 3*b* which are slightly V-shaped as seen in a cross-section through the hat beam or which have another nonplanar design. As a further alternative, the roll-forming machine of the invention may also be configured to form a hat beam with a central flange 2 which has a width that varies along the length of the hat beam. Furthermore, the distance between the central flange 2 and the side flanges 3*a*, 3*b* may vary along the length of the hat beam in any other desired manner than here illustrated, and it is of course also possible that this distance is not the same at one end of the hat beam as at the other end thereof.

Figure 1A:
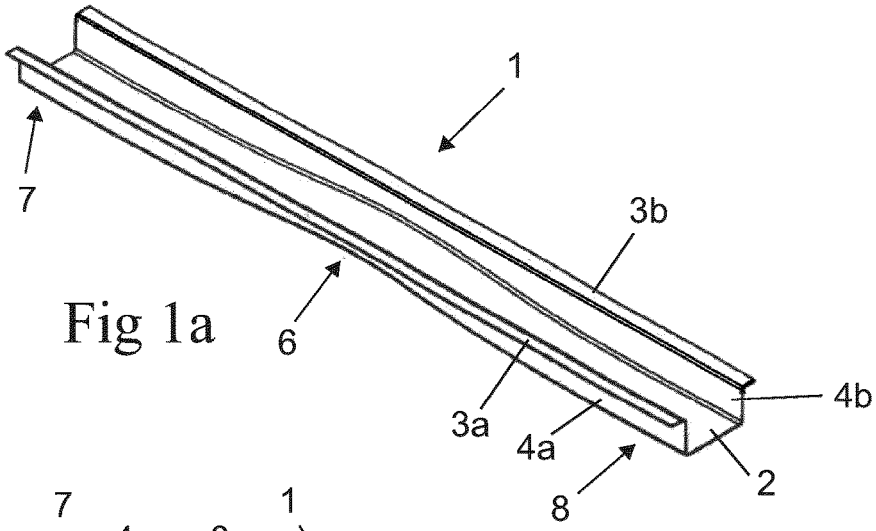
FIG. 1*a* is a perspective view of a hat beam according to a first variant.
Figure 1B:
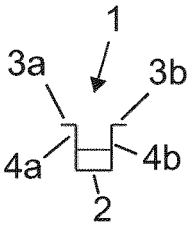
FIG. 1*b* is a front view of the hat beam of FIG. 1*a*.
Figure 1C:
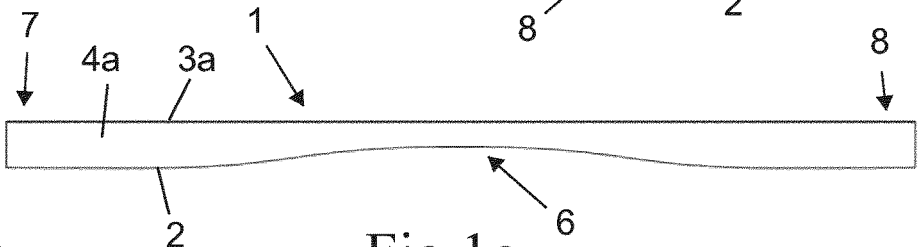
FIG. 1*c* is a lateral view of the hat beam of FIG. 1*a*.
Figure 5:
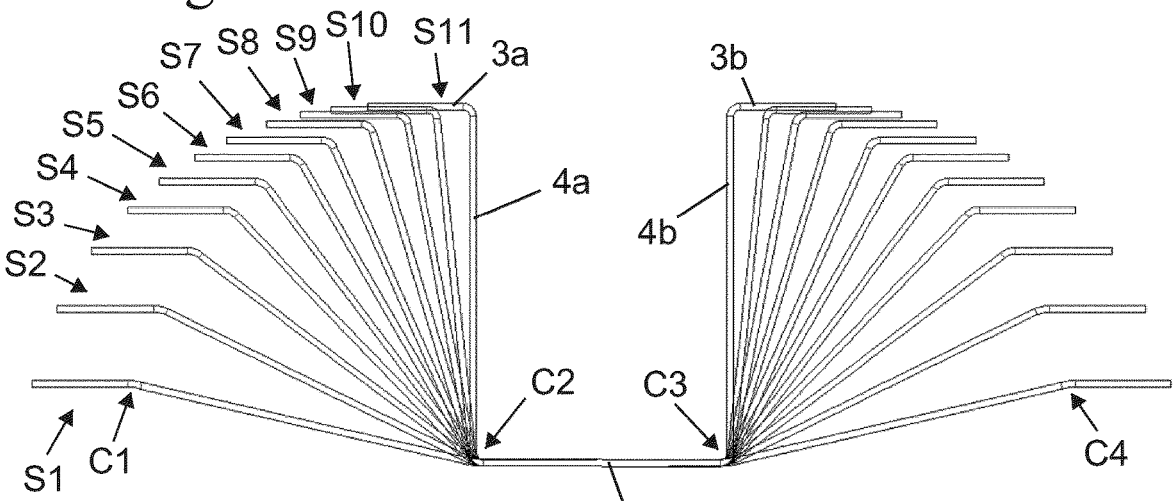
FIG. 5 illustrates consecutive steps for roll-forming the hat beam of FIGS. 1*a*-1*c*, as seen in a cross-section at an end of the hat beam where it has its maximum height.
Figure 6:
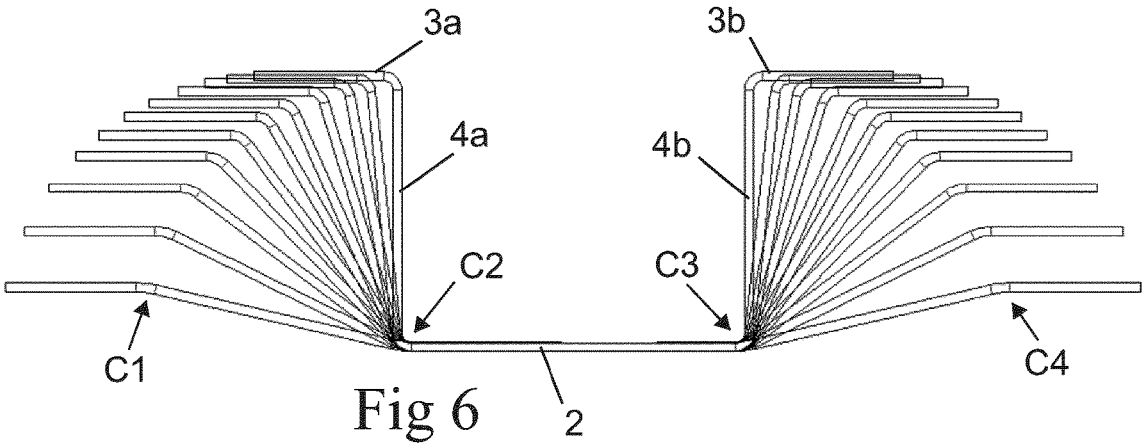
FIG. 6 illustrates consecutive steps for roll-forming the hat beam of FIGS. 1*a*-1*c*, as seen in a cross-section at the middle of the hat beam where it has its minimum height.

The hat beam 1 illustrated in FIGS. 1*a*-1*c* has a section 6 at the middle of the hat beam, as seen in the longitudinal direction thereof, where the central flange 2 bulges inwards, i.e. where the hat beam has a reduced height as compared to the height at the end sections 7, 8 of the hat beam. This hat beam 1 is formed from a plane sheet metal strip 5 which before the roll-forming thereof has been cut to the shape illustrated in FIG. 3, either by means of edge cutters (not shown) included in the roll-forming machine or by means of edge cutters included in a separate cutting unit. In order to transform this plane sheet metal strip 5 into the hat beam 1 illustrated in FIGS. 1*a*-1*c*, the sheet metal strip is subjected to a number of consecutive forming steps in a number of forming stations of the roll-forming machine, wherein the forming stations fold the sheet metal strip 5 along the fold lines F1-F4 illustrated by broken lines in FIG. 3. Each web 4*a*, 4*b* is folded in relation to the central flange 2 and the associated side flange 3*a*, 3*b* in several forming steps S1-S11 effected by different forming stations, where the angle of each folded corner C1-C4 on the sheet metal strip 5 is changed to equal degrees in each forming step, as illustrated in FIGS. 5 and 6. FIG. 5 illustrates the different forming steps at an end section 7, 8 of the hat beam 1 where it has its maximum height, and FIG. 6 illustrates the different forming steps at the middle of the hat beam 1 where it has its minimum height. In the roll-forming machine described below, each side flange 3*a*, 3*b* is maintained at a constant height in one and the same horizontal plane, whereas the vertical position of the central flange 2 is varied, as the sheet metal strip 5 is moved in its longitudinal direction through the different forming stations of the roll-forming machine. However, for the sake of clarity, the central flange 2 is shown at a constant vertical position and the side flanges 3*a*, 3*b* are shown at different vertical positions in the different forming steps S1-S11 illustrated in FIGS. 5 and 6.

Figure 2A:
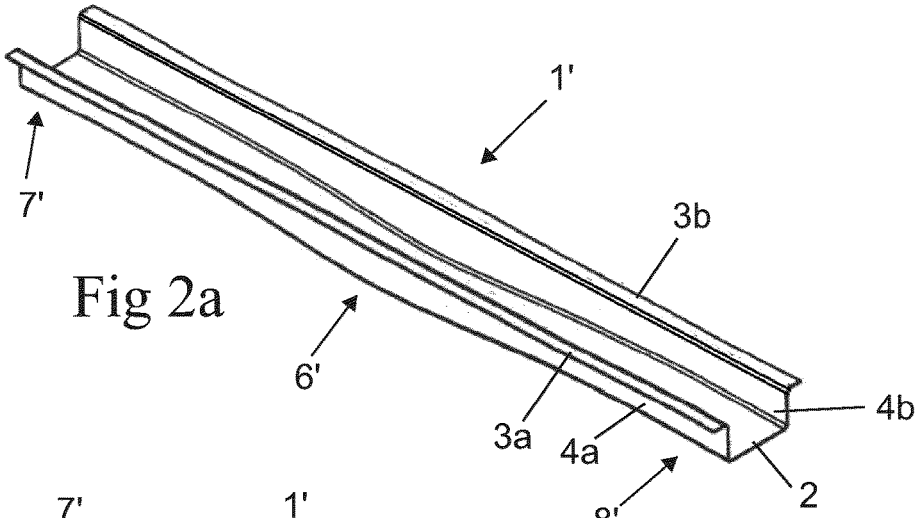
FIG. 2*a* is a perspective view of a hat beam according to another variant.
Figure 2B:
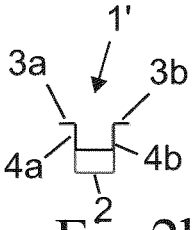
FIG. 2*b* is a front view of the hat beam of FIG. 2*a*.
Figure 2C:
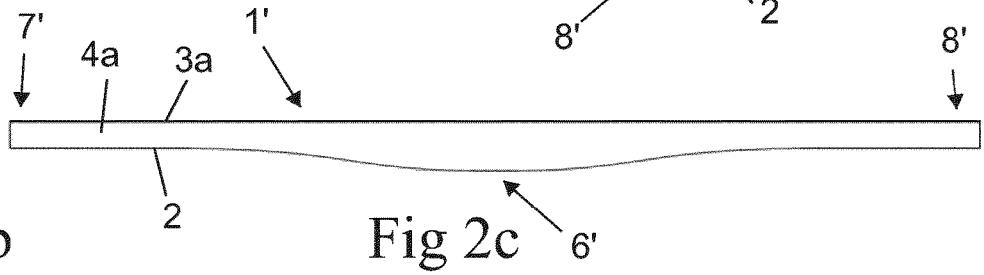
FIG. 2*c* is a lateral view of the hat beam of FIG. 2*a*.

The hat beam 1' illustrated in FIGS. 2*a*-2*c* has a section 6' at the middle of the hat beam, as seen in the longitudinal direction thereof, where the central flange 2 bulges outwards, i.e. where the hat beam has an increased height as compared to the height at the end sections 7', 8' of the hat beam. This hat beam 1' is formed from a plane sheet metal strip 5', which before the roll-forming thereof has been cut to the shape illustrated in FIG. 4. In order to transform this plane sheet metal strip 5' into the hat beam 1' illustrated in FIGS. 2*a*-2*c*, the sheet metal strip is subjected to a number of consecutive forming steps in a number of forming stations of the roll-forming machine, wherein the forming stations fold the sheet metal strip 5' along the fold lines F1-F4 illustrated by broken lines in FIG. 4. Each web 4*a*, 4*b* is folded in relation to the central flange 2 and the associated side flange 3*a*, 3*b* in several forming steps S1-S11 in the manner described above.

The sheet metal strip 5, 5' is to be fed in its longitudinal direction through the consecutively arranged forming stations 20*a*, 20*b* of the roll-forming machine. The intended feeding direction of the sheet metal strip 5, 5' through the forming stations is in the following referred to as the feeding direction.

Figure 7:
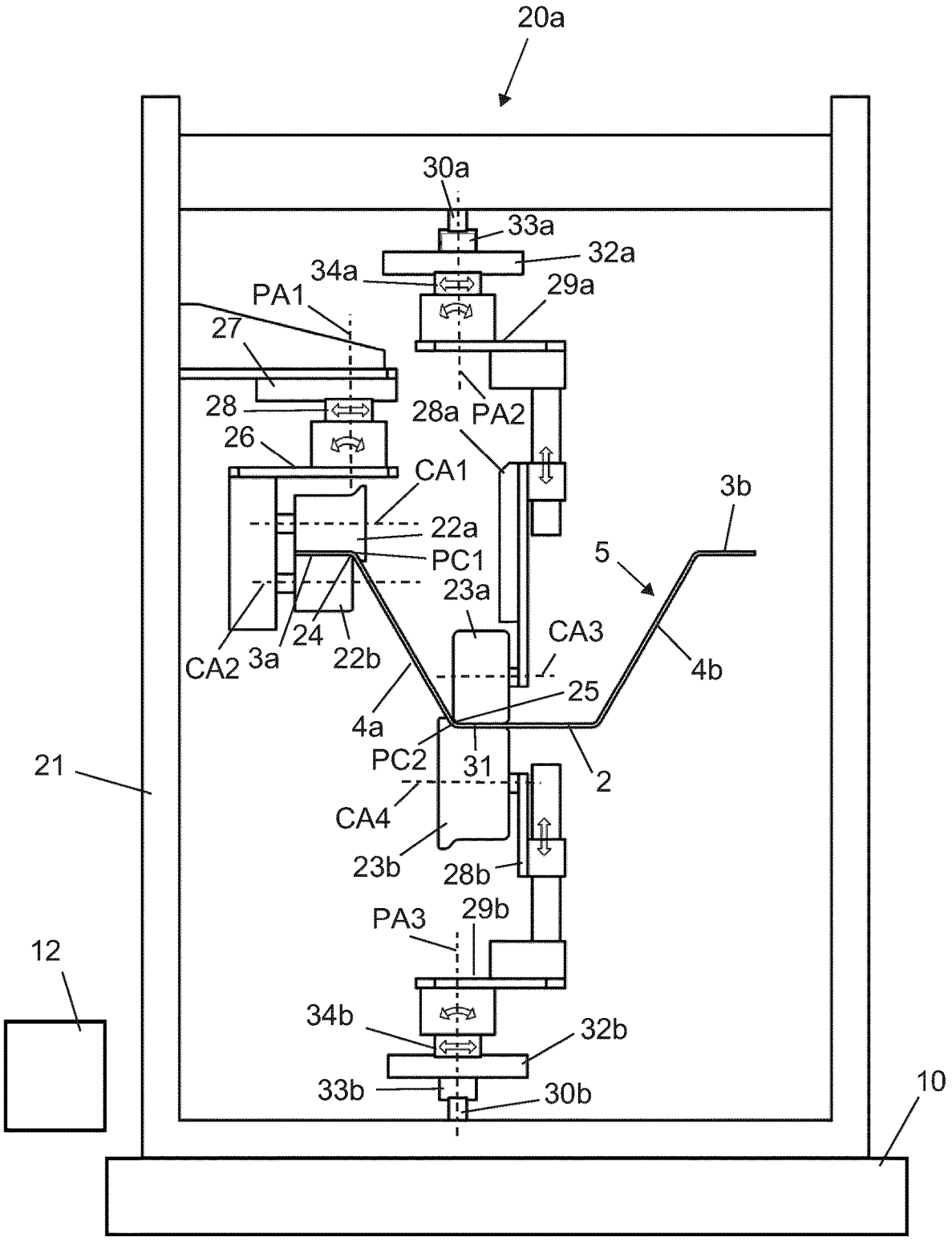
FIG. 7 is a schematic illustration of one of the forming stations included in a roll-forming machine according to the present invention.
Figure 8:
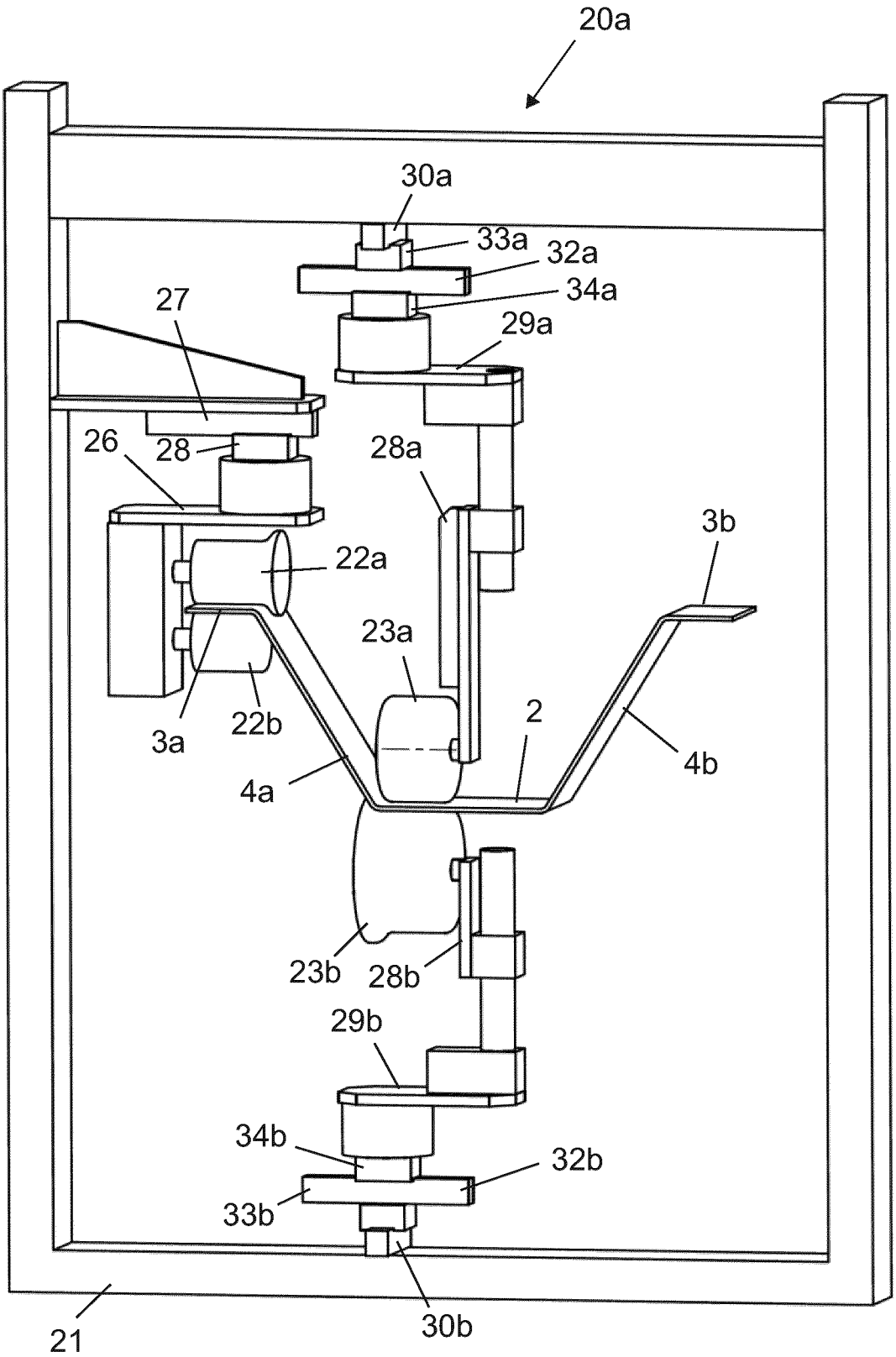
FIG. 8 is a schematic perspective view of the forming station of FIG. 7.
Figure 11:
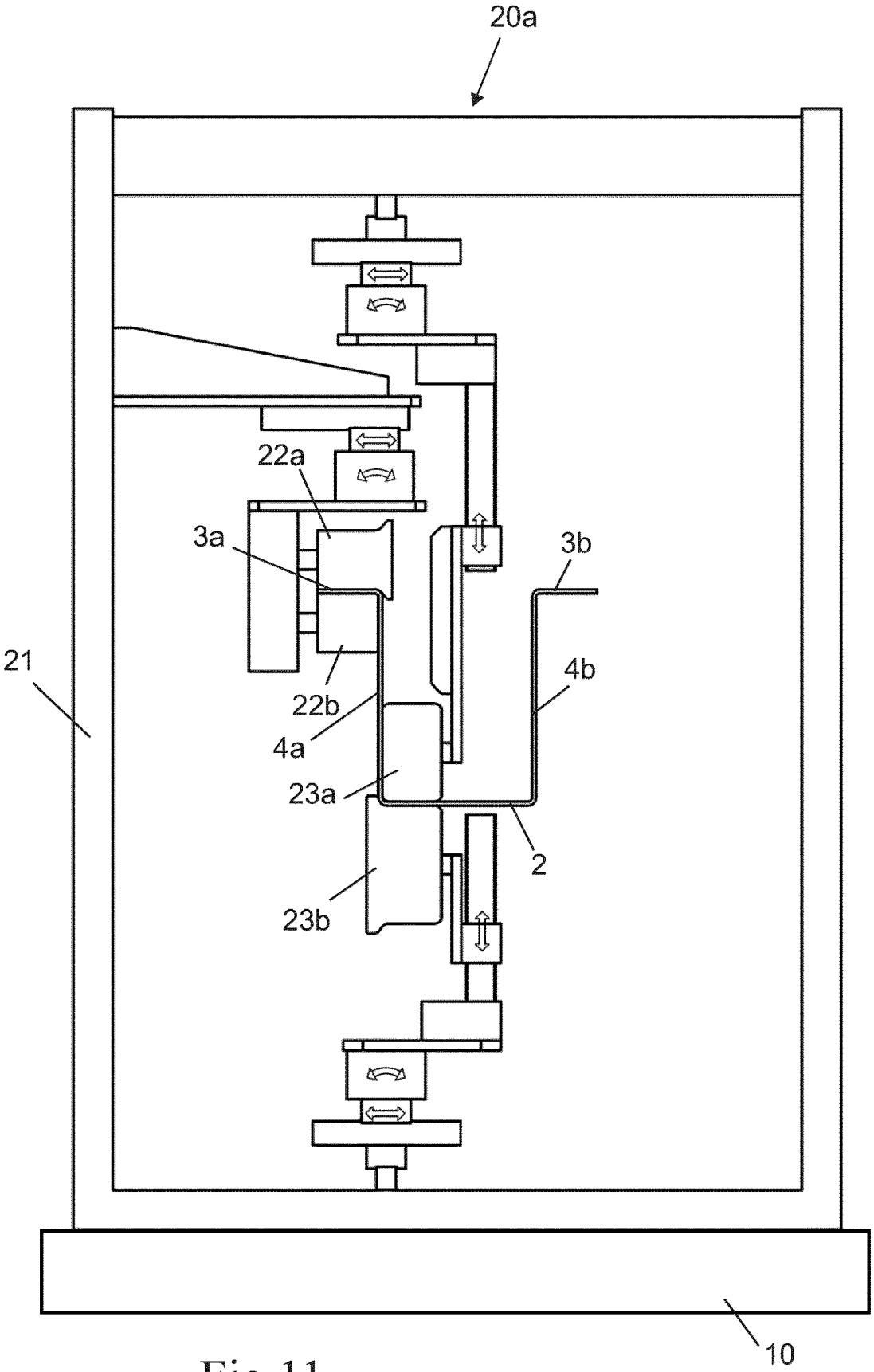
FIG. 11 is a schematic illustration of the final forming station of a roll-forming machine according to the invention.
Figure 12:
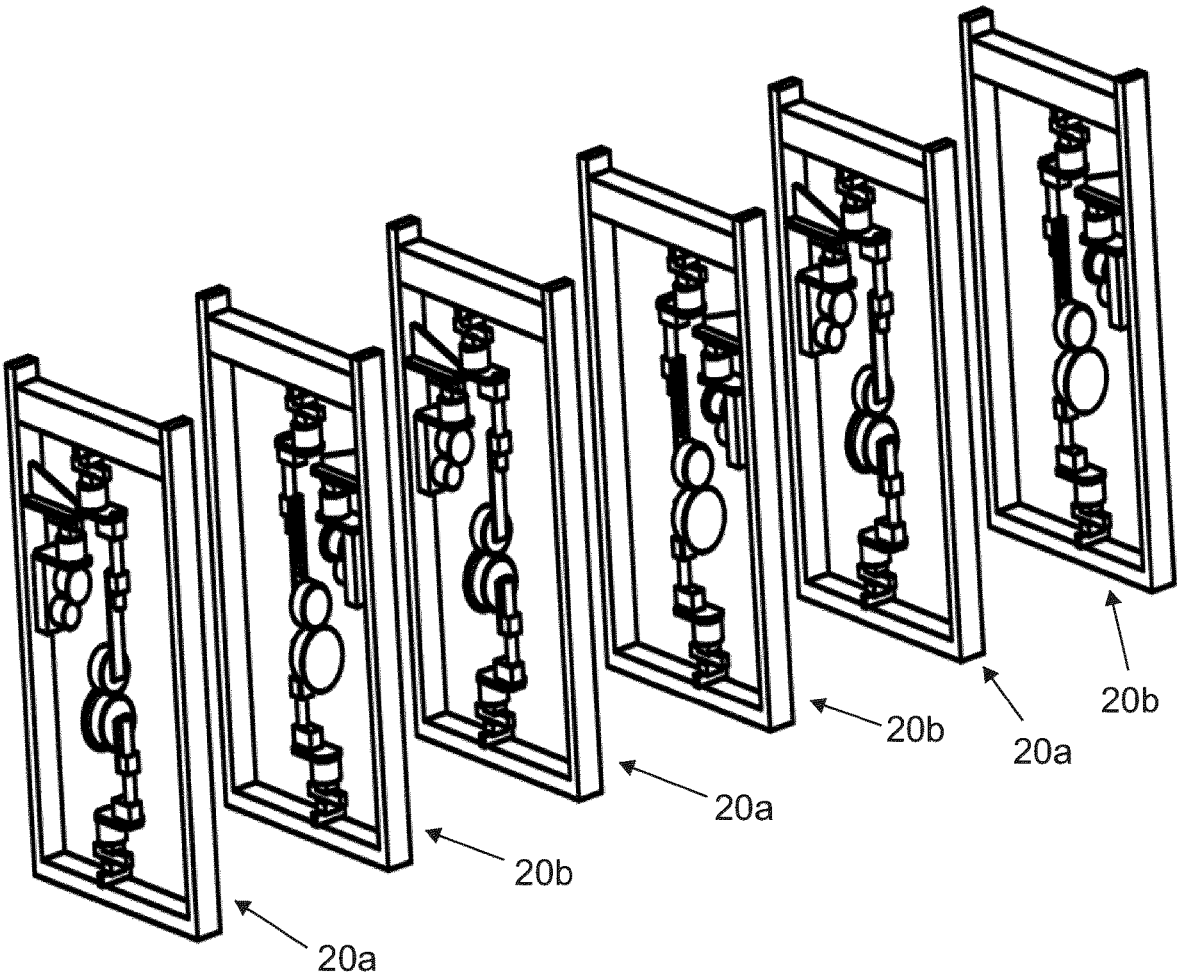
FIG. 12 is a schematic perspective view of a number of consecutive forming stations of a roll-forming machine according to the invention.

Two forming stations 20*a* included in a roll-forming machine according to an embodiment of the present invention are illustrated in FIGS. 7 and 11. The forming stations 20*a* have the same design and are configured to form one side of the hat beam 1, the left side as seen in FIGS. 7 and 11. The other side of the hat beam 1, the right side as seen in FIGS. 7 and 11, is formed by forming stations 20*b* (see FIG. 12) which have the same design as the forming stations illustrated in FIGS. 7 and 11 but are inverted about a vertical axis as compared to the forming stations illustrated in FIGS. 7 and 11. Thus, in this case, the forming stations are divided into a number of first forming stations 20*a* configured to form a first side of the hat beam 1 and a corresponding number of second forming stations 20*b* configured to form an opposite second side of the hat beam 1, wherein the clamping rollers of each first forming station 20*a* are configured to fold only the first web 4*a* in relation to the first side flange 3*a* and in relation to the central flange 2 and wherein the clamping rollers of each second forming station 20*b* are configured to fold only the second web 4*b* in relation to the second side flange 3*b* and in relation to the central flange 2. The first and second forming stations 20*a*, 20*b* are alternately arranged as seen in the feeding direction, as illustrated in FIG. 12, wherein each first forming station 20*a* is followed by one of the second forming stations 20*b* and vice versa. Thus, the first and second forming stations 20*a*, 20*b* are arranged in zigzag along the feeding direction. With this design and arrangement of the forming stations 20*a*, 20*b*, it will be possible to form hat beams 1, 1' where the width of the central flange 2 is relatively small.

The roll-forming machine has a stand 10 (very schematically illustrated in FIGS. 7 and 11), which is to be arranged in a fixed position on a support surface at a production site. Each forming station 20*a*, 20*b* comprises a frame 21 which is fixed to and carried by the stand 10 and which in its turn supports the clamping rollers 22*a*, 22*b*, 23*a*, 23*b* of the forming station.

Each forming station 20*a*, 20*b* comprises a first pair of clamping rollers 22*a*, 22*b* configured to clamp one of the side flanges 3*a*, 3*b* and a second pair of clamping rollers 23*a*, 23*b* configured to clamp the central flange 2. Thus, one side flange 3*a*, 3*b* is clamped between the two clamping rollers 22*a*, 22*b* of the first pair of clamping rollers and the central flange 2 is clamped between the two clamping rollers 23*a*, 23*b* of the second pair of clamping rollers. The first pair of clamping rollers comprises an upper clamping roller 22*a*, which is configured to be in contact with the associated side flange 3*a* from above, and an opposite lower clamping roller 22*b*, which is configured to be in contact with the associated side flange 3*a* from below. The second pair of clamping rollers comprises an upper clamping roller 23*a*, which is configured to be in contact with the central flange 2 from above, and an opposite lower clamping roller 23*b*, which is configured to be in contact with the central flange 2 from below.

The first and second pairs of clamping rollers 22*a*, 22*b*, 23*a*, 23*b* are configured to hold one of the webs 4*a*, 4*b* freely stretched between the first pair of clamping rollers 22*a*, 22*b* and the second pair of clamping rollers 23*a*, 23*b* and to fold this web 4*a*, 4*b* in relation to the associated side flange 3*a*, 3*b* over a first peripheral folding edge 24 on the lower clamping roller 22*b* of the first pair of clamping rollers and in relation to the central flange 2 over a second peripheral folding edge 25 on the upper clamping roller 23*a* of the second pair of clamping rollers. Thus, in each first forming station 20*a*, the first peripheral folding edge 24 is to follow the fold line F1 and the corresponding corner C1 between the first side flange 3*a* and the first web 4*a* and the second peripheral folding edge 25 is to follow the fold line F2 and the corresponding corner C2 between the first web 4*a* and the central flange 2, whereas in each second forming station 20*b*, the first peripheral folding edge 24 is to follow the fold line F4 and the corresponding corner C4 between the second side flange 3*b* and the second web 4*b* and the second peripheral folding edge 25 is to follow the fold line F3 and the corresponding corner C3 between the second web 4*b* and the central flange 2.

Each clamping roller 22*a*, 22*b*, 23*a*, 23*b* has a horizontal centre axis CA1-CA4 and is rotatable about an axis of rotation that coincides with the centre axis of the clamping roller. At least one of the clamping rollers in each pair of clamping rollers, and preferably both clamping rollers in each pair, is driven in rotation by means of its drive motor (not shown), preferably in the form of an electric drive motor.

The clamping rollers 22*a*, 22*b* of the first pair of clamping rollers are mounted to a common support 26, which is configured to be horizontally displaceable sideways transversally to the feeding direction along a transverse horizontal guide rail 27. In the illustrated example, the support 26 is supported by the guide rail 27 via a connecting member 28, which is slidably mounted to the guide rail 27. The guide rail 27 is in its turn fixedly connected to the frame 21. Furthermore, the support 26 is pivotable about a vertical pivot axis PA1, which preferably intersects the first peripheral folding edge 24. In the illustrated example, the support 26 is rotatably mounted to the connecting member 28 and configured to be pivoted about the vertical pivot axis PA1 by rotation of the support 26 in relation to the connecting member 28. Thus, the clamping rollers 22*a*, 22*b* of the first pair of clamping rollers are moveable together by movement of the support 26 in relation to the guide rail 27 and in relation to the connecting member 28.

Figure 9:
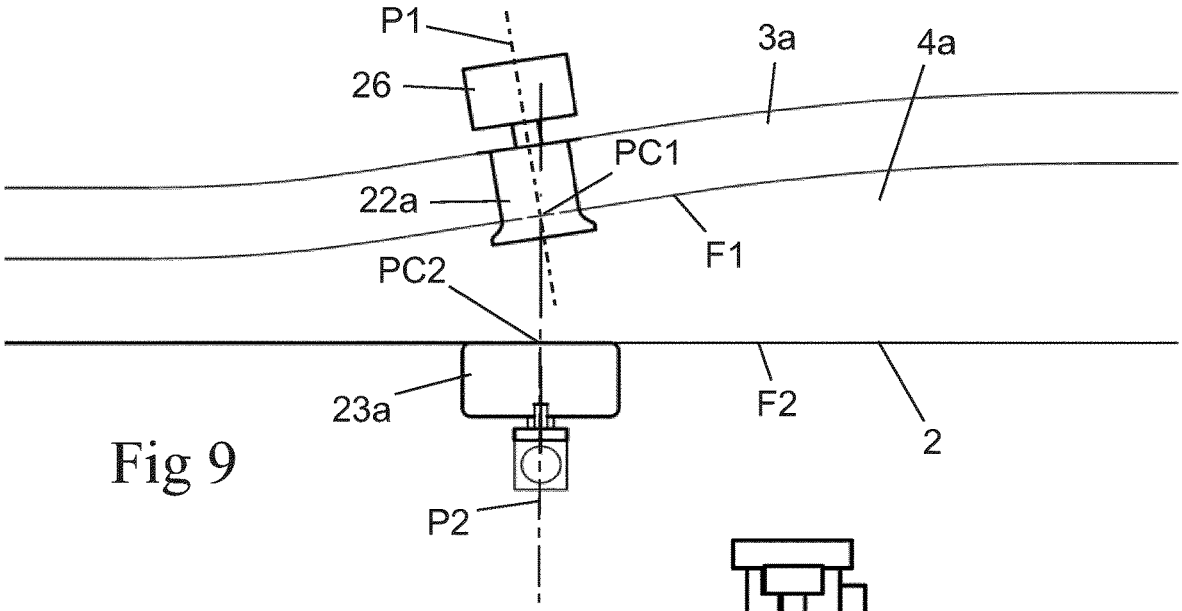
FIG. 9 is a schematic planar view from above of the forming station of FIG. 7, FIGS. 10*a*-10*c* are schematic lateral views of the forming station of FIG. 7, as seen with the clamping rollers of the second pair of clamping rollers in different mutual positions.

The roll-forming machine comprises an electronic control device 12 (very schematically illustrated in FIG. 7), which is configured to control the sideways displacement and the pivoting of the above-mentioned support 26 during a forming operation in such a manner that the first peripheral folding edge 24 follows the fold line F1 and the corresponding corner C1 between the freely stretched web 4*a* and the associated side flange 3*a* and in such a manner that a vertical plane P1 (see FIG. 9) that goes through the centre axes CA1, CA2 of both clamping rollers 22*a*, 22*b* of the first pair of clamping rollers is always maintained perpendicular to the part of this fold line F1 that is in contact with the first peripheral folding edge 24, i.e. perpendicular to the part of the corner C1 between the freely stretched web 4*a* and the associated side flange 3*a* that is in contact with the first peripheral folding edge 24.

The above-mentioned support 26 could also be configured to be horizontally displaceable forwards and backwards in the feeding direction along a horizontal guide rail in order to allow the position of the support 26 in the feeding direction to be adjustable under the control of the electronic control device 12 during a forming operation and thereby allow the support 26 to be moved in such a manner that the first pair of clamping rollers 22*a*, 22*b* can be turned about a vertical axis that intersects the point of contact PC1 between the first peripheral folding edge 24 and the sheet metal strip 5. However, such an adjustability of the support 26 has not been illustrated in FIGS. 7 and 11 and is not necessary if the support 26 is pivotable about a pivot axis PA1 that intersects said point of contact PC1.

The clamping rollers 23*a*, 23*b* of the second pair of clamping rollers are configured to be individually displaceable during a forming operation upwards and downwards in vertical direction and horizontally forwards and backwards in the feeding direction. In the illustrated example, each clamping rollers 23*a*, 23*b* of the second pair of clamping rollers is carried by a holder 28*a*, 28*b*, which in its turn is supported by and vertically moveable in relation to a support 29*a*, 29*b*. Each support 29*a*, 29*b* is configured to be horizontally displaceable forwards and backwards in the feeding direction along a horizontal guide rail 30*a*, 30*b*, which is fixed to the frame 21. The electronic control device 12 is configured to control the displacement of these clamping rollers 23*a*, 23*b* during a forming operation in such a manner that a plane P2 (see FIGS. 10*a*-10*c*) that goes through the centre axes CA3, CA4 of both clamping rollers 23*a*, 23*b* of the second pair of clamping rollers is always maintained perpendicular to the part of the central flange 2 received in the nip 31 between these clamping rollers 23*a*, 23*b*.

Figure 10A:
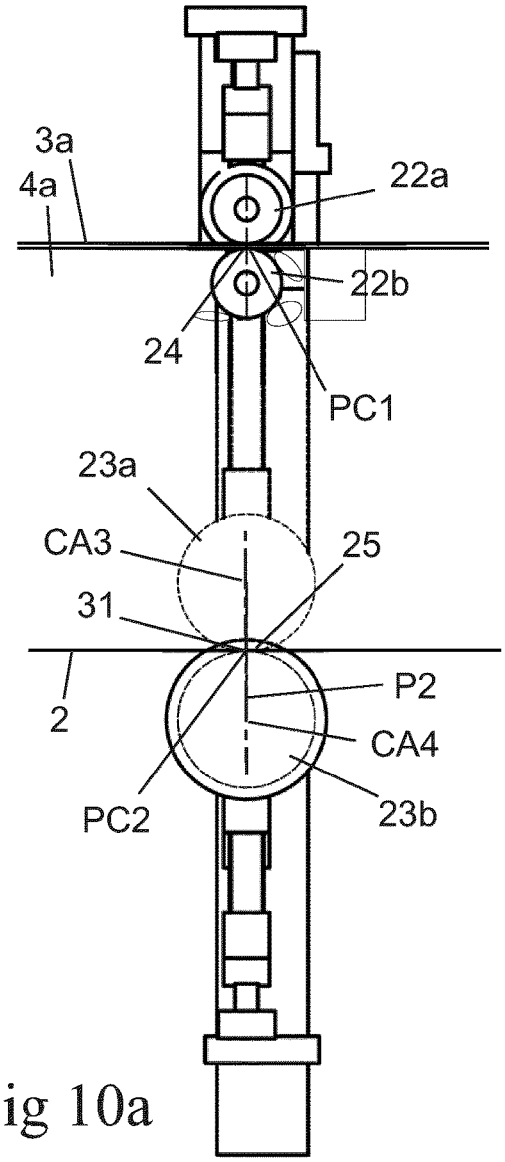
Figure 10B:
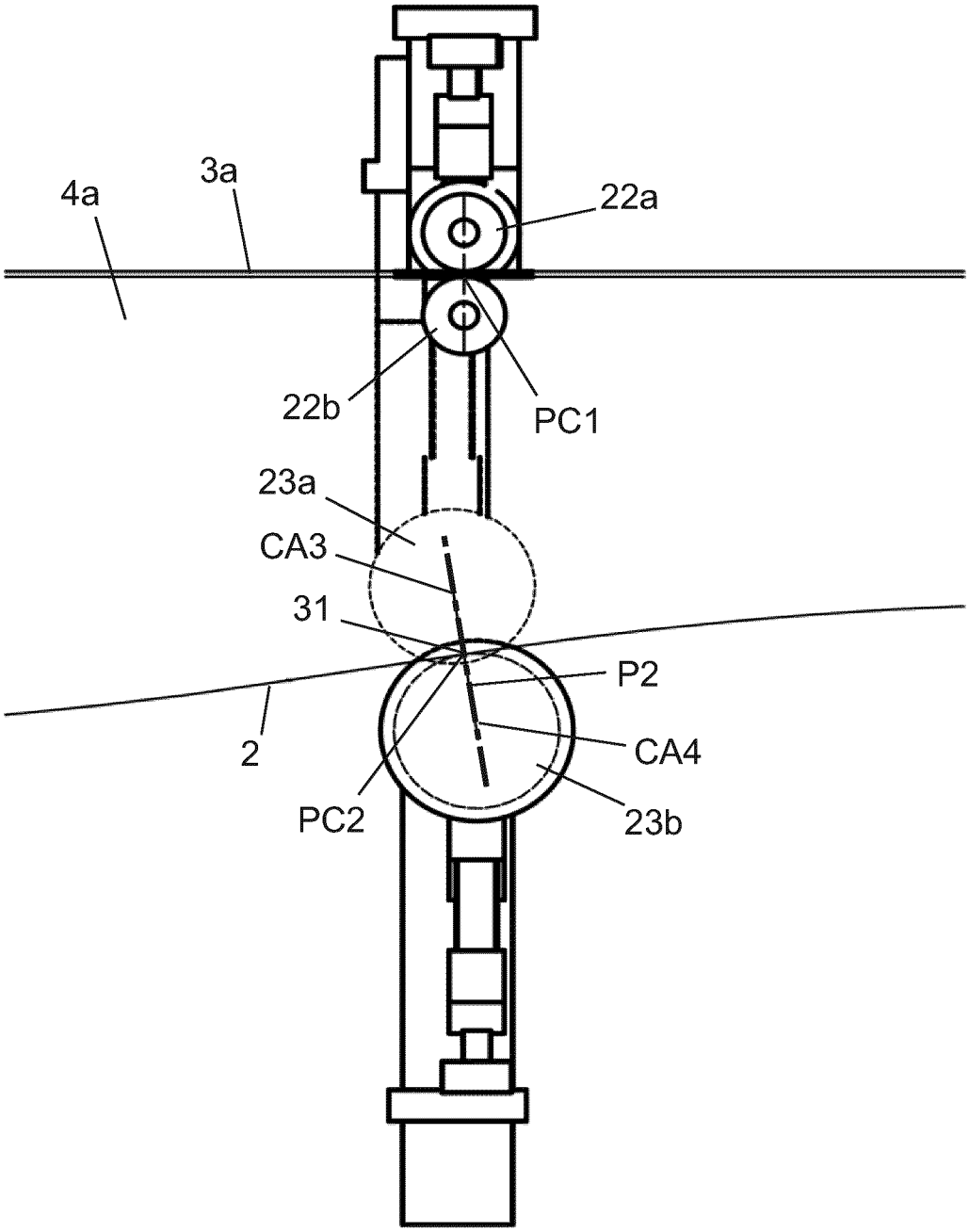
Figure 10C:
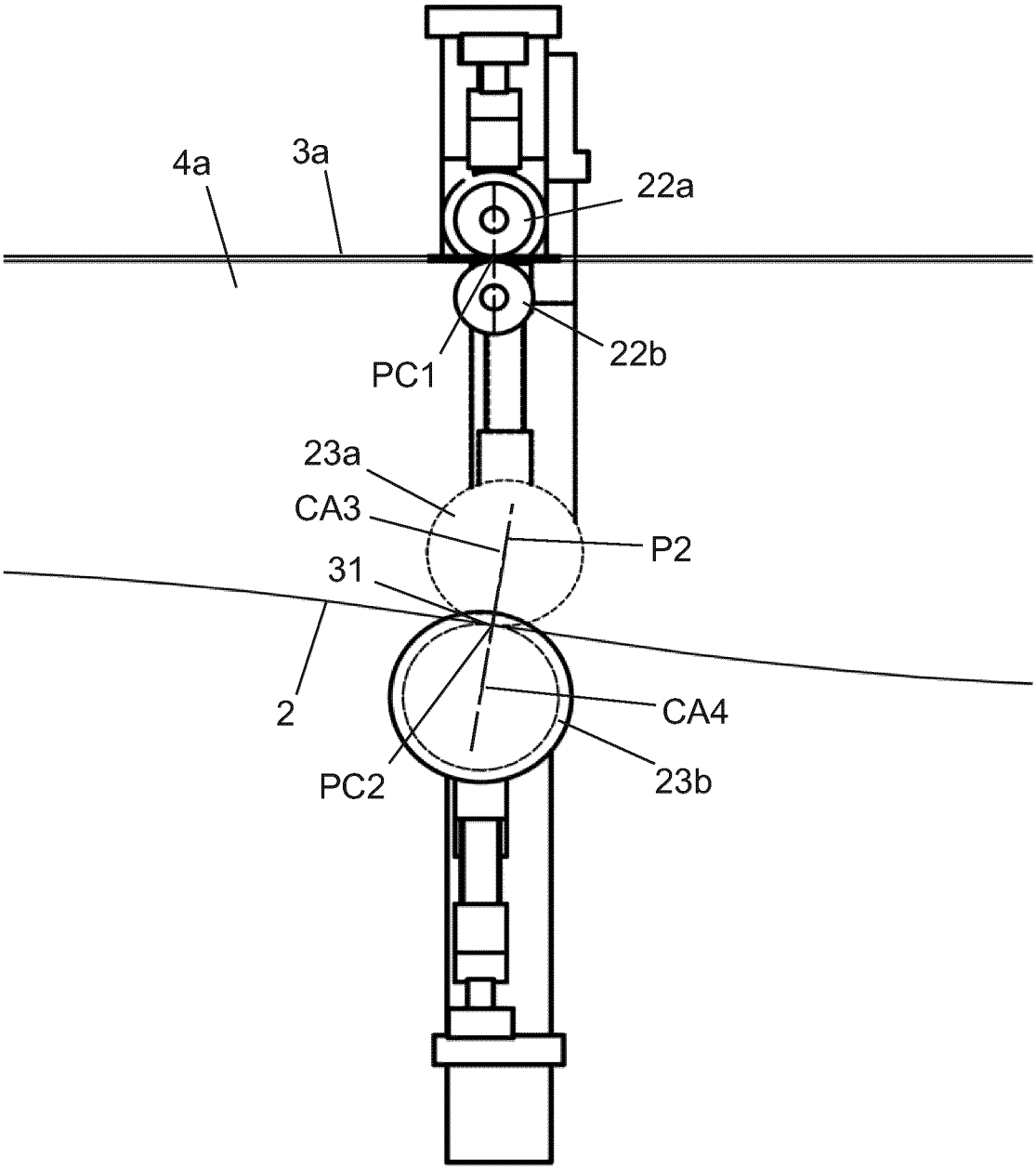

The electronic control device 12 is preferably also configured to control the individual movements of the clamping rollers 23*a*, 23*b* of the second pair of clamping rollers during a forming operation and/or the movements of the first pair of clamping rollers 22*a*, 22*b* in the feeding direction during a forming operation in such a manner that the point of contact PC2 between the second peripheral folding edge 25 and the sheet metal strip 5 is always maintained in the same cross-sectional plane through the sheet metal strip 5 as the point of contact PC1 between the first peripheral folding edge 24 and the sheet metal strip 5, as illustrated in FIGS. 10*a*-10*c*.

Figure 3:
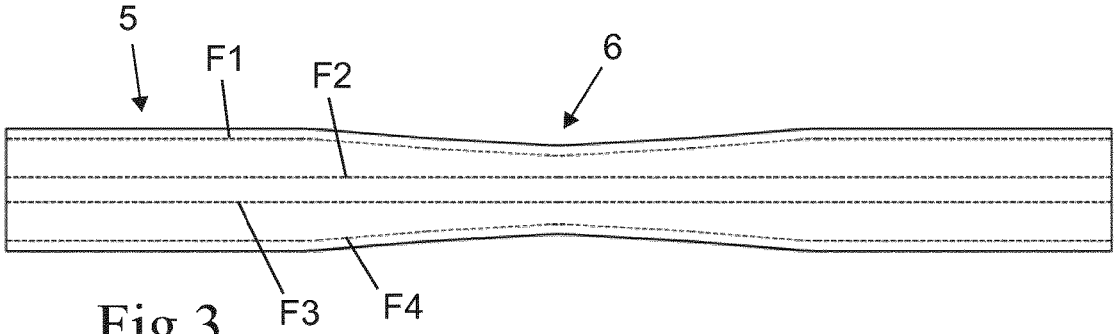
FIG. 3 is a planar view of a flat sheet metal strip with illustrated fold lines to be used for producing the hat beam of FIGS. 1*a*-1*c*.
Figure 4:
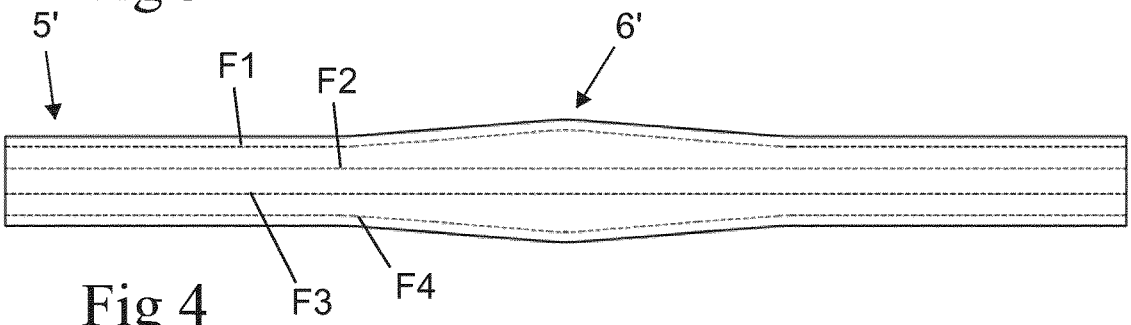
FIG. 4 is a planar view of a flat sheet metal strip with illustrated fold lines to be used for producing the hat beam of FIGS. 2*a*-2*c*.

When the width of the central flange 2 is constant throughout the length of the hat beam 1, 1', the fold lines F2, F3 between the central flange 2 and the webs 4*a*, 4*b* will be straight, as shown in FIGS. 3 and 4. However, if the width of the central flange 2 varies along the length of the hat beam 1, these fold lines F2, F3 will be curved or inclined along the parts of the sheet metal plate 5 where the width of the central flange 2 varies.

If the roll-forming machine is to be used for forming a hat beam with a central flange 2 which has a width that varies along the length of the hat beam, the clamping rollers 23*a*, 23*b* of the second pair of clamping rollers should also be configured to be individually and horizontally displaceable sideways transversally to the feeding direction and individually pivotable about a vertical pivot axis PA2, PA3 during a forming operation. In this case, the electronic control device 12 is configured to control the sideways displacement and the pivoting of these clamping rollers 23*a*, 23*b* during a forming operation in such a manner that the second peripheral folding edge 25 follows the fold line F2, F3 and the corresponding corner C2, C3 between the freely stretched web 4*a*, 4*b* and the central flange 2 and in such a manner that the above-mentioned plane P2 that goes through the centre axes CA3, CA4 of both clamping rollers 23*a*, 23*b* of the second pair of clamping rollers is always maintained perpendicular to the part of this fold line F2, F3 that is in contact with the second peripheral folding edge 25, i.e. perpendicular to the part of the corner C2, C3 between the freely stretched web 4*a*, 4*b* and the central flange 2 that is in contact with the second peripheral folding edge 25.

In the example illustrated in FIGS. 7 and 11, each one of the above-mentioned supports 29*a*, 29*b* of the clamping rollers 23*a*, 23*b* of the second pair of clamping rollers is configured to be horizontally displaceable sideways transversally to the feeding direction along a transverse horizontal guide rail 32*a*, 32*b*, which is supported by the above-mentioned guide rail 30*a*, 30*b* via a first connecting member 33*a*, 33*b* that is slidably mounted to the last-mentioned guide rail 30*a*, 30*b*. The support 29*a*, 29*b* is supported by the transverse horizontal guide rail 32*a*, 32*b* via a second connecting member 34*a*, 34*b*, which is slidably mounted to this guide rail 32*a*, 32*b*. Furthermore, the support 29*a*, 29*b* is pivotable about a vertical pivot axis PA2, PA3, wherein the vertical pivot axis PA2 of the support 29*a* associated with the upper clamping roller 23*a* preferably intersects the second peripheral folding edge 25. In the illustrated example, the support 29*a*, 29*b* is rotatably mounted to the second connecting member 34*a*, 34*b* and configured to be pivoted about the vertical pivot axis PA2, PA3 by rotation of the support 29*a*, 29*b* in relation to the second connecting member 34*a*, 34*b*.

Power devices for effecting the different movements of the clamping rollers 22*a*, 22*b*, 23*a*, 23*b* described above have been omitted in the drawings for the sake of clarity and in order to facilitate the illustration of other parts of the forming stations. These power devices are with advantage electric motors in order to enable a control of the movements of the clamping rollers 22*a*, 22*b*, 23*a*, 23*b* with high accuracy, but it would also be possible to use other types of power devices, such as for instance pneumatically or hydraulically controlled power devices. The operation of the power devices is controlled by the electronic control device 12 in accordance with pre-programmed algorithms.

The electronic control device 12 may be implemented by one single electronic control unit or by two or more mutually co-operating electronic control units.

The invention is of course not in any way limited to the embodiments described above. On the contrary, several possibilities to modifications thereof should be apparent to a person skilled in the art without thereby deviating from the basic idea of the invention as defined in the appended claims.

The invention claimed is:

1. A roll-forming machine comprising a number of forming stations (20*a*, 20*b*) for successively roll-forming a flat sheet metal strip (5, 5') into a hat beam (1, 1') having a profile that varies along its length and which has a central flange (2), first and second side flanges (3*a*, 3*b*) on opposite sides of the central flange (2), a first web (4*a*) extending between the central flange (2) and the first side flange (3*a*) and a second web (4*b*) extending between the central flange (2) and the second side flange (3*b*), wherein each forming station (20*a*, 20*b*) comprises a first pair of clamping rollers (22*a*, 22*b*) for clamping one of the side flanges (3*a*, 3*b*) and a second pair of clamping rollers (23*a*, 23*b*) for clamping the central flange (2), the first and second pairs of clamping rollers (22*a*, 22*b*, 23*a*, 23*b*) are configured to fold one of the webs (4*a*, 4*b*) in relation to the associated side flange (3*a*, 3*b*) over a first peripheral folding edge (24) on a clamping roller (22*b*) in the first pair of clamping rollers, and in relation to the central flange (2) over a second peripheral folding edge (25) on a clamping roller (23*a*) in the second pair of clamping rollers;

the clamping rollers (23*a*, 23*b*) of the second pair of clamping rollers are configured to be individually displaceable during a forming operation upwardly and downwardly in a vertical direction and horizontally forwardly and backwardly in a feeding direction of the sheet metal strip (5, 5') through the forming stations (20*a*, 20*b*); and the roll-forming machine additionally comprises an electronic control device (12) configured to control the displacement of the clamping rollers (23*a*, 23*b*) of the second pair of clamping rollers during the forming operation such that a plane (P2) passing through centre axes (CA3, CA4) of both clamping rollers (23*a*, 23*b*) of the second pair of clamping rollers is always maintained perpendicular to a part of the central flange (2) received in a nip (31) between the clamping rollers (23*a*, 23*b*) of the second pair of clamping rollers.

2. A roll-forming machine according to claim 1, wherein the clamping rollers (22*a*, 22*b*) of said first pair of clamping rollers are mounted to a support (26) configured to be displaceable sideways transversally to said feeding direction and pivotable about a vertical pivot axis (PA1) during the forming operation, and the electronic control device (12) is configured to control the sideways displacement and the pivoting of the support (26) during the forming operation such that said first peripheral folding edge (24) follows a fold line (F1, F4) between said web (4*a*, 4*b*) and the associated side flange (3*a*, 3*b*) and a plane (P1) passing through centre axes (CA1, CA2) of both clamping rollers (22*a*, 22*b*) of the first pair of clamping rollers is always maintained perpendicular to a part of the fold line (F1, F4) in contact with the first peripheral folding edge (24).

3. A roll-forming machine according to claim 2, wherein said vertical pivot axis (PA1) intersects the first peripheral folding edge (24).

4. A roll-forming machine according to claim 1, wherein the clamping rollers (23*a*, 23*b*) of the second pair of clamping rollers are configured to be individually displaceable sideways transversally to said feeding direction and individually pivotable about a vertical pivot axis (PA2, PA3) during the forming operation; and the electronic control device (12) is configured to control the sideways displacement and the pivoting of the clamping rollers (23*a*, 23*b*) of the second pair of clamping rollers during the forming operation such that said second peripheral folding edge (25) follows a fold line (F2, F3) between said web (4*a*, 4*b*) and the central flange (2) and a plane (P2) passing through centre axes (CA3, CA4) of both clamping rollers (23*a*, 23*b*) of the second pair of clamping rollers is always maintained perpendicular to a part of the fold line (F2, F3) in contact with the second peripheral folding edge (25).

5. A roll-forming machine according to claim 4, wherein the vertical pivot axis (PA2) of the clamping roller (23*a*) provided with the second peripheral folding edge (25) intersects the second peripheral folding edge (25).

6. A roll-forming machine according to claim 1, wherein the forming stations comprise a number of first forming stations (20*a*) and a corresponding number of second forming stations (20*b*);

the clamping rollers (22*a*, 22*b*, 23*a*, 23*b*) of each first forming station (20*a*) are configured to fold only the first web (4*a*) in relation to the first side flange (3*a*) and in relation to the central flange (2);

the clamping rollers (22*a*, 22*b*, 23*a*, 23*b*) of each second forming station (20*b*) are configured to fold only the second web (4*b*) in relation to the second side flange (3*b*) and in relation to the central flange (2); and the first and second forming stations (20*a*, 20*b*) are alternately arranged in said feeding direction.

7. A roll-forming machine according to claim 1, wherein the electronic control device (12) is configured to control the individual movements of the clamping rollers (23*a*, 23*b*) of the second pair of clamping rollers and/or the movements of the first pair of clamping rollers (22*a*, 22*b*) during the forming operation such that a point of contact (PC2) between the second peripheral folding edge (25) and the sheet metal strip (5) is always maintained in the same cross-sectional plane through the sheet metal strip (5) as a point of contact (PC1) between the first peripheral folding edge (24) and the sheet metal strip (5).

8. A method for successively roll-forming, in a number of forming stations (20*a*, 20*b*), a flat sheet metal strip (5, 5') into a hat beam (1, 1') which has a profile that varies along its length and which has a central flange (2), first and second side flanges (3*a*, 3*b*) on opposite sides of the central flange (2), a first web (4*a*) extending between the central flange (2) and the first side flange (3*a*) and a second web (4*b*) extending between the central flange (2) and the second side flange (3*b*), the method comprising the steps of clamping, in each forming station (20*a*, 20*b*), one of the side flanges (3*a*, 3*b*) between two clamping rollers (22*a*, 22*b*) of a first pair of clamping rollers, and clamping the central flange (2) between two clamping rollers (23*a*, 23*b*) of a second pair of clamping rollers, folding, with the first and second pairs of clamping rollers (22*a*, 22*b*, 23*a*, 23*b*), one of the webs (4*a*, 4*b*) in relation to the associated side flange (3*a*, 3*b*) over a first peripheral folding edge (24) on a clamping roller (22*b*) in the first pair of clamping rollers, and in relation to the central flange (2) over a second peripheral folding edge (25) on a clamping roller (23*a*) in the second pair of clamping rollers, individually displacing the clamping rollers (23*a*, 23*b*) of the second pair of clamping rollers during a forming operation upwardly and downwardly in a vertical direction and horizontally forwardly and backwardly in a feeding direction of the sheet metal strip (5, 5') through the forming stations (20*a*, 20*b*), and controlling the displacement of the clamping rollers (23*a*, 23*b*) of the second pair of clamping rollers during the forming operation with an electronic control device (12) such that a plane (P2) passing through centre axes (CA3, CA4) of both clamping rollers (23*a*, 23*b*) of the second pair of clamping rollers is always maintained perpendicular to a part of the central flange (2) received in a nip (31) between the clamping rollers (23*a*, 23*b*) of the second pair of clamping rollers.

9. A method according to claim 8, comprising the steps of mounting the clamping rollers (22*a*, 22*b*) of said first pair of clamping rollers to a support (26) configured to be displaceable sideways transversally to said feeding direction and pivotable about a vertical pivot axis (PA1) during the forming operation, and controlling, with the electronic control device (12), sideways displacement and pivoting of the support (26) during the forming operation such that said first peripheral folding edge (24) follows a fold line (F1, F4) between said web (4*a*, 4*b*) and the associated side flange (3*a*, 3*b*), and a plane (P1) passing through centre axes (CA1, CA2) of both clamping rollers (22*a*, 22*b*) of the first pair of clamping rollers is always maintained perpendicular to a part of the fold line (F1, F4) in contact with the first peripheral folding edge (24).

10. A method according to claim 9, wherein said vertical pivot axis (PA1) intersects the first peripheral folding edge (24).

11. A method according to claim 8, comprising the steps of individually displacing the clamping rollers (23*a*, 23*b*) of the second pair of clamping rollers sideways transversally to said feeding direction, and individually pivoting the clamping rollers (23*a*, 23*b*) of the second pair of clamping rollers about a vertical pivot axis (PA2, PA3) during the forming operation, and controlling, with the electronic control device (12), the sideways displacement and the pivoting of the clamping rollers (23*a*, 23*b*) of the second pair of clamping rollers during the forming operation such that said second peripheral folding edge (25) follows a fold line (F2, F3) between said web (4*a*, 4*b*) and the central flange (2) and that the plane (P2) passing through the centre axes (CA3, CA4) of both clamping rollers (23*a*, 23*b*) of the second pair of clamping rollers is always maintained perpendicular to a part of the fold line (F2, F3) in contact with the second peripheral folding edge (25).

12. A method according to claim 11, wherein the vertical pivot axis (PA2) of the clamping roller (23*a*) provided with the second peripheral folding edge (25) intersects the second peripheral folding edge (25).

13. A method according to claim 8, wherein the forming stations comprise a number of first forming stations (20*a*) and a corresponding number of second forming stations (20*b*), and comprising the steps of alternately arranging the first and second forming stations (20*a*, 20*b*) in said feeding direction, folding, with the clamping rollers (22*a*, 22*b*, 23*a*, 23*b*) of each first forming station (20*a*), fold only the first web (4*a*) in relation to the first side flange (3*a*) and in relation to the central flange (2), and feeding, with the clamping rollers (22*a*, 22*b*, 23*a*, 23*b*) of each second forming station (20*b*), only the second web (4*b*) in relation to the second side flange (3*b*) and in relation to the central flange (2).

14. A method according to claim 8, comprising the step of controlling, with the electronic control device (12), individual movements of the clamping rollers (23*a*, 23*b*) of the second pair of clamping rollers and/or the movements of the first pair of clamping rollers (22*a*, 22*b*) during the forming operation such that a point of contact (PC2) between the second peripheral folding edge (25) and the sheet metal strip (5) is always maintained in the same cross-sectional plane through the sheet metal strip (5) as a point of contact (PC1) between the first peripheral folding edge (24) and the sheet metal strip (5).

* * * * *